US005353715A

United States Patent [19]

Luyk

[11] Patent Number: 5,353,715

[45] Date of Patent: Oct. 11, 1994

[54] LEG ATTACHMENTS FOR A HEIGHT ADJUSTABLE FOLDING TABLE

[75] Inventor: Harley E. Luyk, Grand Rapids, Mich.

[73] Assignee: William S. Wilburn, Grand Rapids, Mich.

[21] Appl. No.: 924,712

[22] Filed: Aug. 3, 1992

[51] Int. Cl.[5] ..... A47B 9/16

[52] U.S. Cl. ..... 108/116; 108/119; 108/120

[58] Field of Search ..... 108/50, 115, 116, 118, 108/119, 124, 140, 144, 145, 147, 127, 120; 248/188.2, 188.6, 188.8; 312/107, 107.5, 107.6, 114, 223.3; 297/56, 57, 119, 135, 136

[56] References Cited

U.S. PATENT DOCUMENTS

| | | | |
|---|---|---|---|
| 846,105 | 3/1907 | Harris et al. | 108/122 |
| 848,465 | 3/1907 | Homeyer | 108/145 |
| 1,939,459 | 12/1933 | Murray | 108/121 |
| 2,508,405 | 5/1950 | Lazard | 108/145 |
| 2,531,233 | 11/1950 | Pettit | 311/39 |
| 2,566,668 | 9/1951 | Krueger | 108/145 X |
| 2,601,357 | 6/1952 | Allbritton | 108/118 |
| 2,843,391 | 7/1958 | Pellettier | 108/116 |
| 4,095,843 | 6/1978 | Hirsch | 297/136 |
| 4,296,694 | 10/1981 | Kobayashi | 108/116 |
| 4,718,355 | 1/1988 | Houghton | 108/147 |
| 4,825,780 | 5/1989 | Maxwell et al. | 108/144 |
| 4,827,850 | 5/1989 | Diffrient | 108/50 |
| 5,109,778 | 5/1992 | Berkowitz et al. | 108/127 |

FOREIGN PATENT DOCUMENTS 0446623 9/1991 European Pat. Off. ..... 108/116

OTHER PUBLICATIONS

Redfold Brochure, Grand Rapids, Michigan, 1988.
Redco Brochure, The Table Source, undated.
Redco, Tables in Ten Quick Ship Program, undated.

*Primary Examiner*—Clifford D. Crowder
*Assistant Examiner*—Ismael Izaguirre
*Attorney, Agent, or Firm*—Varnum, Riddering, Schmidt & Howlett

[57] ABSTRACT

The invention relates to an article of furniture comprising a set of four legs supporting a table top. The first and second legs are pivotally attached to the underside of the table top whereas the third and fourth legs are pivotally mounted to a slide bar mechanism or alternatively selectively mounted to one of several leg mounting retainers on the underside of the table top through a support bar. The first and second legs are pivotally mounted to the third and fourth legs at a mid portion of the legs. The legs are oriented such that the table can be collapsed to a minimum thickness comprising the widest of all of the legs plus the table top. The table is capable of adjustment to one of at least two different height positions by altering the position of the third and fourth legs relative to the table top. A modesty panel can be pivotally mounted to the underside of the table top.

26 Claims, 5 Drawing Sheets

LEG ATTACHMENTS FOR A HEIGHT ADJUSTABLE FOLDING TABLE

BACKGROUND OF THE INVENTION

1. Field of the Invention

This invention relates to an adjustable article of furniture and, more particularly, to a collapsible or folding table which can be assembled in at least two different height positions.

2. Description of Related Art

A problem which has long plagued wheelchair users is the ability to fit the chair comfortably beneath the surface of a table, desk, or conference table. The standard or conventional table height is approximately 29 inches. Unfortunately, the armrests of most wheelchairs extend higher than 29 inches from the ground. A wheelchair user typically requires a table or desk of a height of approximately 31 inches. Because the standard table height is incompatible with the requirements of wheelchair users, these persons have been forced to use tables, desks and conference tables which are unsuitable and uncomfortable.

In recognition of the access rights of wheelchair users, the federal government and many state governments have imposed laws requiring facilities suitable for use by wheelchair users.

These laws will affect restaurant and conference center operators who have long relied on folding tables to provide suitable table space for meals and meetings. After the meal or meeting has concluded, the folding tables are usually collapsed and stored in a flat condition to occupy a minimum of storage space. These public users of folding tables will also be required to make the folding tables accessible by wheelchair users.

SUMMARY OF THE INVENTION

The folding table according to the invention overcomes the problems of the prior art tables discussed above. First, the table according to the invention is a multi-position table which can be easily raised from the standard height to a height suitable for comfortable use by wheelchair users. Secondly, the table according to the invention can be easily folded to a collapsed condition which is flat and uses the minimum storage space.

The article of furniture according to the invention is supported on a supporting surface and comprises a table top, first and second legs pivotally mounted at upper ends thereof to an underside of the tabletop and third and fourth legs pivotally connected respectively to the first and second legs at an intermediate position of each of the first, second, third and fourth legs. A guide track is mounted to the underside of the tabletop and a slide bar is slidably mounted in the guide track. A shacklebar is provided which has a first end pivotally mounted to the slide bar and a second end pivotally mounted to the upper end of the third and fourth legs. The shacklebar selectively supports an upper end of the third and fourth legs in one of two positions relative to the tabletop. A first of the two positions supporting the tabletop a first distance from the supporting surface and a second of the two positions supporting the tabletop a second and different distance from the supporting surface. The slidebar is further slidably mounted to the guidetrack such that the third and fourth legs are movable from the first and second tabletop supporting positions to a collapsed position wherein the legs are substantially parallel to the underside of the tabletop.

In another embodiment, a slidebar mechanism is mounted to the underside of the tabletop and the shacklebar is mounted to the slidebar mechanism. The legs and slidebar mechanism are adapted so that the article can be folded to a collapsed position. The thickness of the article of furniture in the collapsed position is substantially equal to the width of one of the widest of the legs, the thickness of the tabletop and the thickness of the slidebar mechanism.

In a further embodiment, a modesty panel is mounted to the underside of the table top. Preferably, the modesty panel is pivotally mounted to the underside of the table top so that the modesty panel can be positioned parallel to the table top when the legs are collapsed against the underside of the table top.

A table constructed according to the invention overcomes the problems of the prior art by permitting easy adjustment of the table top to one of several height positions to accommodate users of the table. In addition, a table constructed according to the invention can be easily collapsed for storage thereby occupying a minimum amount of valuable storage space.

BRIEF DESCRIPTION OF THE DRAWINGS

The invention will now be described with reference to the drawings wherein.

DESCRIPTION OF THE PREFERRED EMBODIMENT

Figure 1:
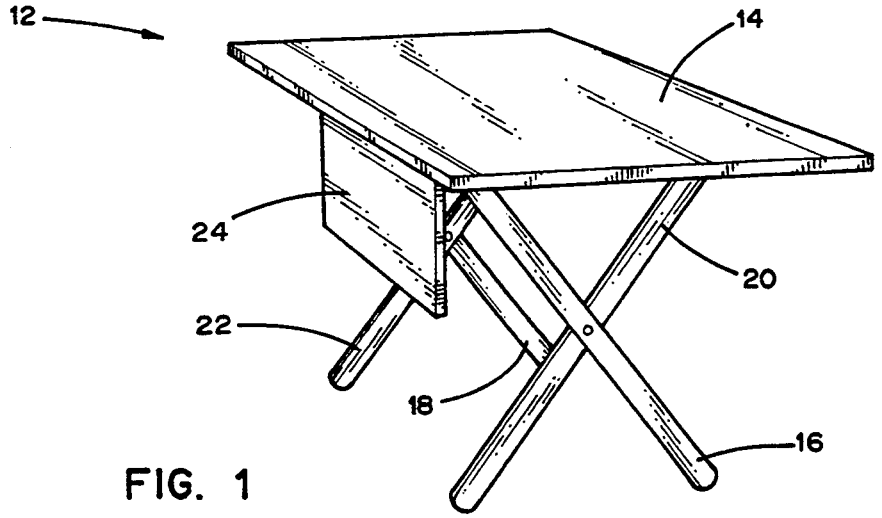
FIG. 1 is a perspective view of the adjustable table according to the invention in the erect state.

Referring now to the drawings and to FIG. 1 in particular, an adjustable table 12 comprises a table top 14, a first leg 16, a second leg 18, a third leg 20, and a fourth leg 22. The first leg 16 is pivotally connected to the third leg 20 by a pivot pin 26. The pivot pin 26 is preferably located at approximately the midpoint of the first and third legs. The second and fourth leg are pivotally connected by a pivot pin in the same manner.

Figure 2:
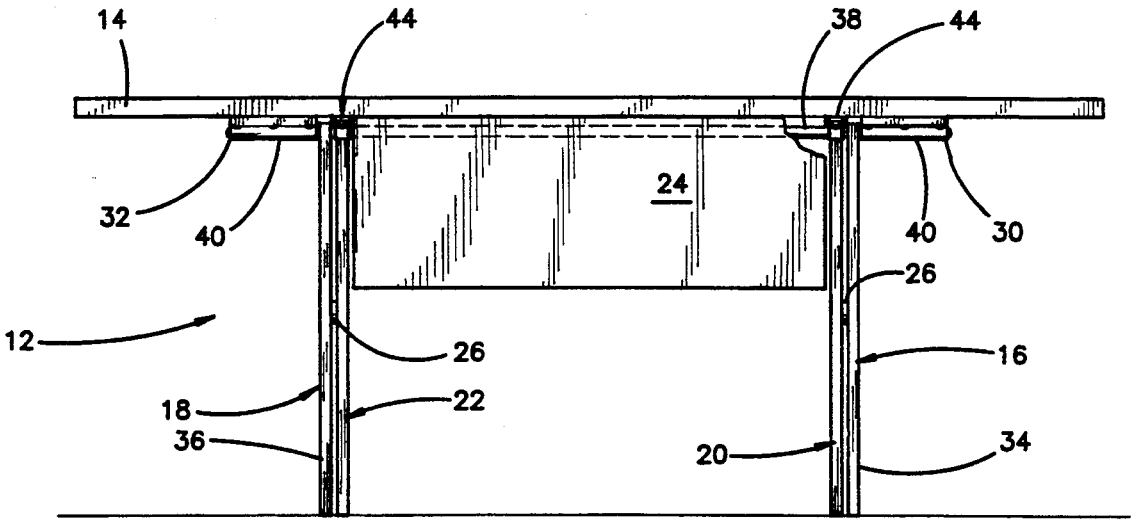
FIG. 2 is a front elevational view of the preferred embodiment of the adjustable table as seen in FIG. 1.
Figure 3:
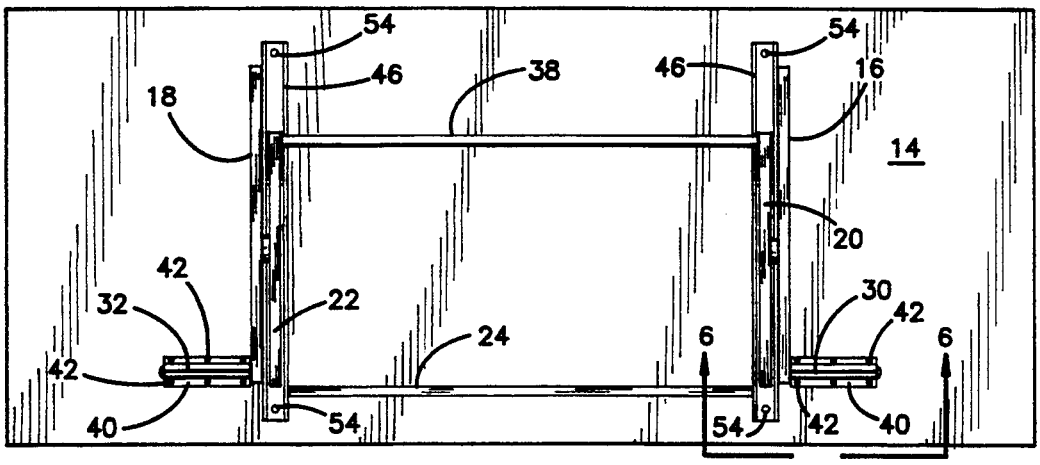
FIG. 3 is a bottom plan view of the preferred embodiment of the adjustable table as seen in FIG. 2.

As seen in FIGS. 2 and 3, the first and second legs, 16, 18, are preferably L-shaped having a horizontal portion, 30, 32, respectively, and a vertical portion 34, 36, respectively. The horizontal portions, 30, 32 of the first and second legs, 16, 18, are preferably mounted to the underside of the table top 14 by a pair of pivot brackets 40. The pivot brackets 40 are secured to the underside of the table top 14 by a plurality of mounting screws 42. As seen in FIG. 3, the pivot brackets 40 pivotally mount the ends of the horizontal portions, 30, 32, of the first and second legs, 16, 18. The L-shaped legs, 16, 18, face outwardly such that the vertical portions, 34, 36, are nearer the midpoint of the table top 14 than the terminal ends of the horizontal portions 30, 32.

Figure 6:
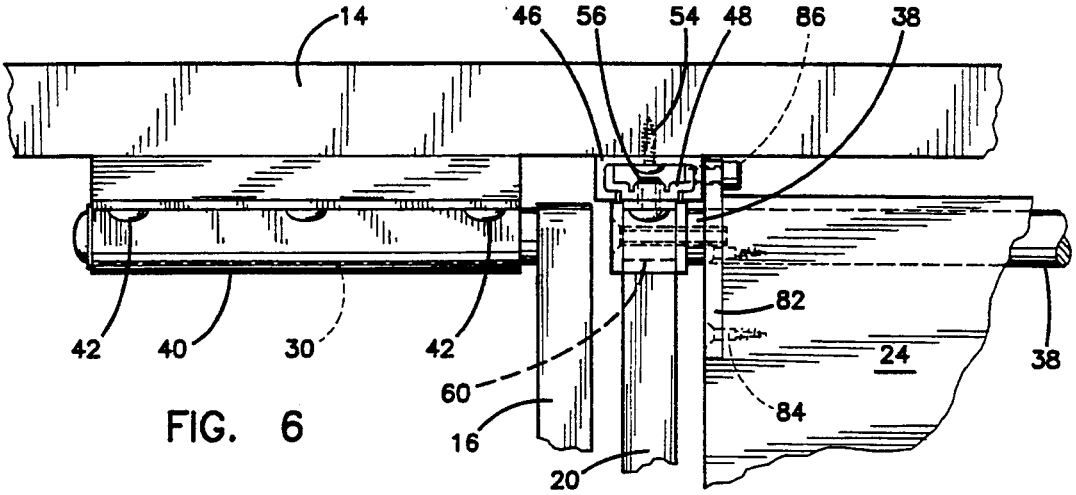
FIG. 6 is a partial sectional view of the slide bar and track of the preferred embodiment taken along lines 6—6 of FIG. 3.
Figure 9:
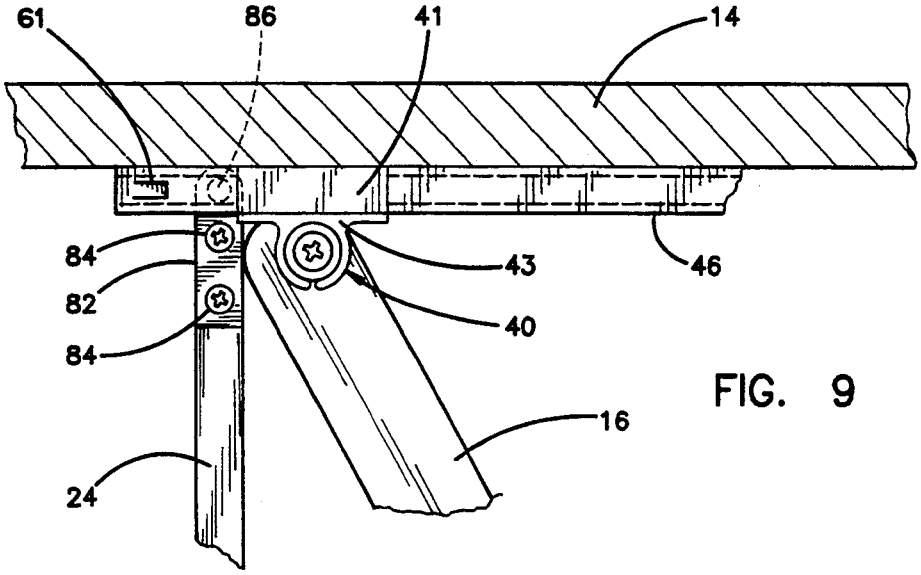
FIG. 9 is a partial side elevational view of the preferred embodiment of the table showing the pivot bracket.

As seen in FIGS. 6 and 9, the pivot bracket 40 preferably comprises a base 41 and a C-shaped receiving bracket 43. The receiving bracket 43 is secured to the base 41 by a plurality of mounting screws 42. The receiving bracket 43 is contoured such that it rotatably receives the horizontal portions, 30, 32, of the first and second legs, 16, 18. The pivot brackets 40 pivotally mount the first and second legs, 16, 18 to the underside of the table top 14 such that the legs 16 and 18 have a minimum arc of rotation of approximately 75 degrees.

As seen in FIGS. 2 and 3, the upper ends of the third and fourth legs, 20, 22, are preferably interconnected by a support bar 38 thereby creating a unitary U-shaped structure. The U-shaped structure of the third and fourth legs, 20, 22, and the support bar 38 is mounted inside of the first and second legs, 16, 18. The support bar 38 is slidably and pivotally mounted to the underside of the table by a slide bar mechanism 44.

A connector is mounted to the underside of the table top and selectively retains the upper end of the third and fourth legs to vary the height of the table top. In the first embodiment, the connector comprises a shackle bar 52, the shackle bar is in turn mounted to a slide bar mechanism. Preferably, two shackle bars 52 are incorporated in the connector, one on each side of the leg. As seen in FIGS. 6–9, the slide bar mechanism comprises a guide track 46 and a pivot mounting 50. The guide track 46 is securely mounted to the underside of the table top 14 by mounting screws 54. The guide track is preferably an inverted U-shape which slidably receives the complementary shaped slide bar 48. The slide bar 48 is adapted to slide substantially the entire length of the guide track 46. Stops 61 are formed near the ends of the guide track 46 to retain the slide bar 48 within the length of the track 46 such that the bar 48 may slide within the guide track 46 between the opposing stops 61. The stops 61 comprise tabs which are struck out from the guide track 46. The tabs are struck out such that they lie within the U-shaped opening of the guide track 46. The slide bar 50 contacts the stop 61 and movement of the slide bar 50 within the track 46 beyond the stop 61 is prevented. Preferably, each end of the guide track 46 has two stops 61 formed thereon, one on each side.

Figure 7:
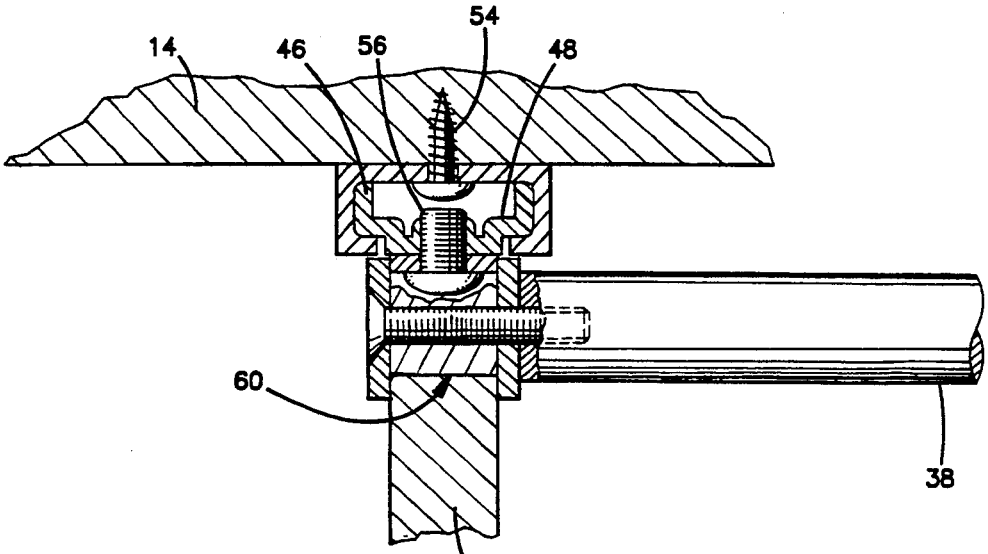
FIG. 7 is a partial sectional view of the detail of the slide bar and track of the preferred embodiment taken along lines 7—7 of FIG. 8.
Figure 8:
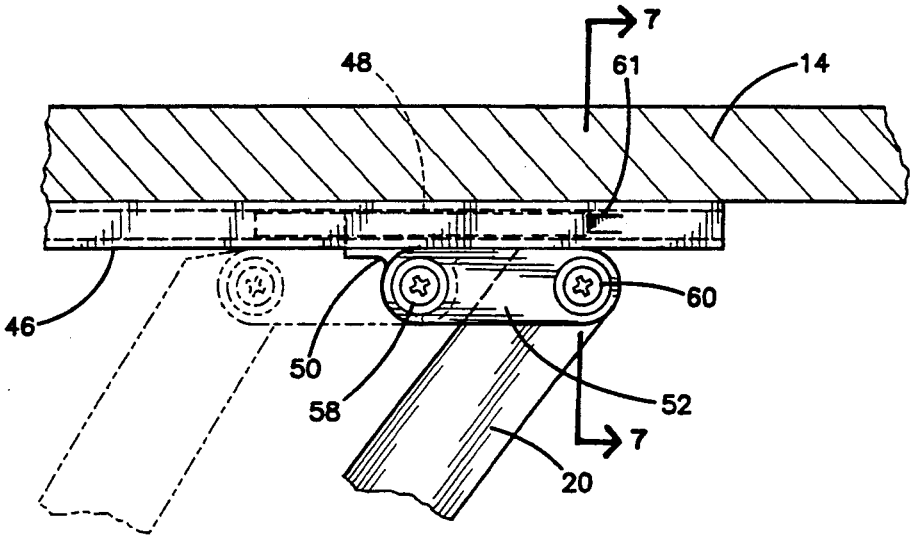
FIG. 8 is a partial side elevational view of the preferred embodiment of the table showing the slide bar mechanism.

The pivot mounting 50 is fixedly secured to the slide bar 48 by a plurality of fasteners 56. One end of the shackle bar 52 is pivotally mounted to a bushing 58 mounted in the pivot mounting 50. The top end of each of the third and fourth legs 20, 22 is pivotally mounted to the other end of the shackle bar 52 by a suitable bushing 60. As seen in FIG. 7, the shackle bar 52 can rotate about an arc of 180° from the pivot mounting. Preferably, two shackle bars 52 are mounted on the ends of each of the third and fourth legs 20, 22.

Figure 4:
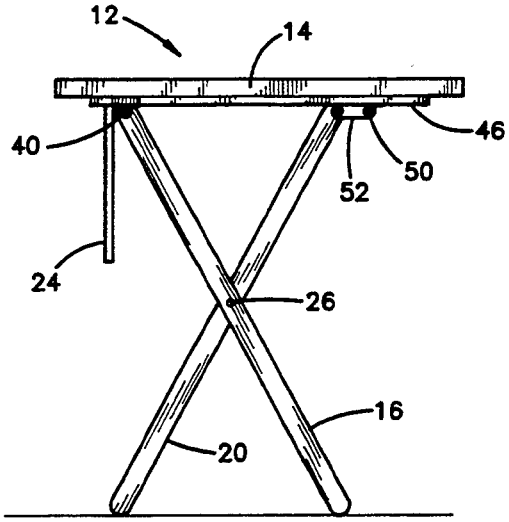
FIG. 4 is a side elevational view of the preferred embodiment of the adjustable table in the first or upper erect state.
Figure 5:
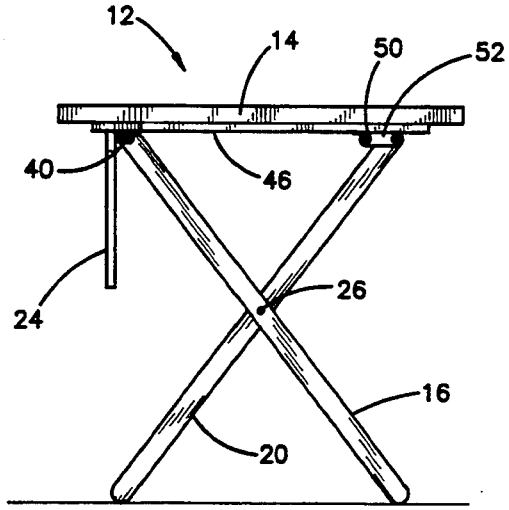
FIG. 5 is a side elevational view of the preferred embodiment of the adjustable table in the second or lower erect state.

The rotation of the top of the third and fourth legs 20, 22 and the shackle bars 52 about the pivot mounting permits adjustment of the height of the table top. As seen in FIG. 4, the table is in the first or upper erect state when the shackle bars 52 are pivoted such that the top of the legs 20, 22 are closer to the centerline of the table. The table can be quickly and easily adjusted to the second or lower erect state, as seen in FIG. 5 by lifting the table top 14 slightly and pivoting the shackle bars 52 and legs 20, 22 about the pivot mounting 50. In the lower erect state, the ends of the legs 20, 22 are closer to the edge of the table top 14. The first and second legs 16, 18 cooperate in the pivoting movement of the third and fourth legs 20, 22 because of the linkage between the adjoining legs through the pivot pin 26.

In the preferred embodiment, the height of the table in the second erect position as seen in FIG. 5 is approximately 29 inches, a standard table height. The height of the table top in the first erect position as seen in FIG. 4, is approximately 31 inches, a height suitable for use with a wheelchair.

Figure 10:
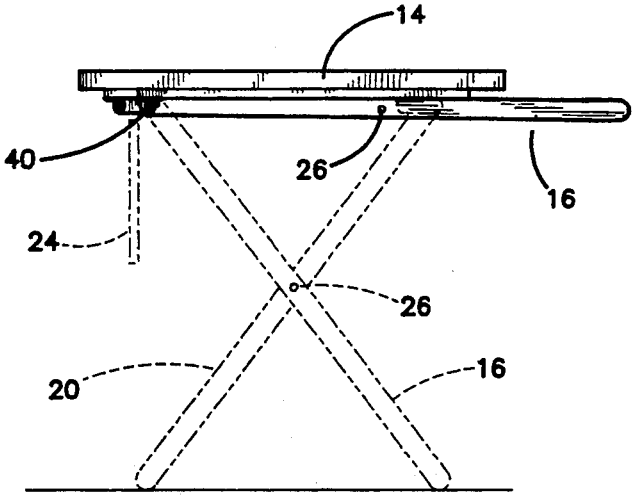
FIG. 10 is a side elevational view of the preferred embodiment of the table in its collapsed state, the adjustable table in its lower erect state being depicted in phantom lines.
Figure 11:
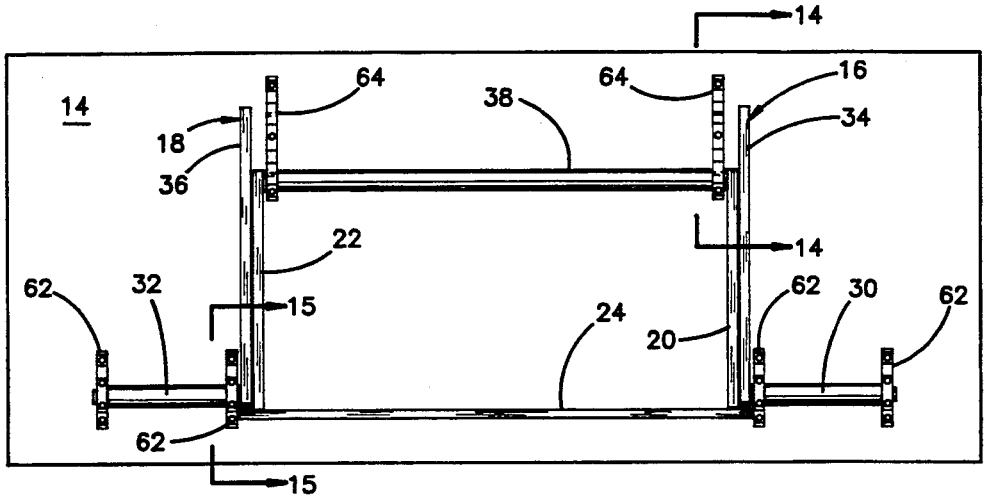
FIG. 11 is a bottom plan view of a second embodiment of the table as seen in FIG. 1.

The adjustable table according to the invention can also be folded flat into a collapsed position as seen in FIG. 10 through the cooperation of the pivot mounting 50, slide bar 48 and guide track 46. As seen in FIG. 3, the guide track 46 spans substantially the entire width of the table top 14. The table is collapsed by first pivoting the shackle bars 52 and legs 20, 22 to the lowered position as seen in FIG. 5. Then, the lower end of the first and second legs 16, 18 is swung about an arc to the left as seen in FIG. 5 until the slide bar mechanism 44 has traversed substantially the entire length of the guide track 46 and the legs, 16, 18, 20, 22 are parallel. This movement is accomplished through the cooperation between each of the several pivot points of the legs, the shackle bar 52 and the slide bar mechanism 44. Once the legs are parallel to one another, the legs may be folded flat such that they abut the underside of the table 14 as seen in FIG. 9. In this collapsed position, the article of furniture has a thickness equal to the thickness of the table top, the thickness of the widest of the legs and the thickness of the guide track 46. The collapsed article of furniture occupies a minimum amount of space and may be easily stored.

A second embodiment of the adjustable table according to the invention is disclosed in FIGS. 11–16. Like reference numerals will designate like parts from the preferred embodiment throughout the various views.

The second embodiment of the adjustable table 12 similarly comprises a table top 14 and a pair of legs 16, 18 pivotally attached to the underside of the table top 14 and a pair of legs 20, 22 adjustably mounted to the underside of the table top 14. The first and second legs 16, 18 are pivotally attached to the underside of the table top by pivot brackets 62. The pivot bracket 62 of the second embodiment accomplishes the same function as the pivot bracket 40 of the first embodiment, namely pivotally securing the first and second legs to the table top. The pivot bracket 62 of the second embodiment comprise a base 63 and a cover plate 65. The cover plate 65 is secured to the base 63 by a plurality of mounting screws 67, the base 63 is fixedly mounted to the underside of the table top 14 by a plurality of mounting screws 69. The adjoining surfaces of the base 63 and cover plate 65 are contoured such that they rotatably receive the horizontal portions, 30, 32 of the first and second legs, 16, 18. The pivot brackets 62 permit a minimum arc of rotation of approximately 75 degrees for the first and second legs 16, 18.

The support bar 38 is selectively mounted to the underside of the table by connectors which in this embodiment comprise a pair of adjustment brackets 64. The adjustment brackets 64 are secured to the underside of the table top 14 by a plurality of mounting screws 66.

Figure 14:
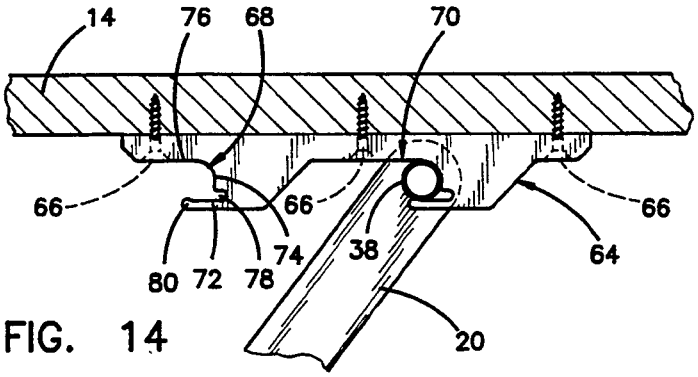
FIG. 14 is a partial sectional view of the second embodiment of the table showing the adjustment bracket taken along lines 14—14 of FIG. 11.

As seen in FIG. 14, each adjustment bracket 64 has a plurality of tube receiving openings which define leg mounting retainers to selectively retain the support bar 38. Preferably, a first and second tube receiving openings, 68 and 70, are provided.

Each tube receiving opening 68, 70 is generally U-shaped and selectively receives the support bar 38 within the U-shaped opening. The U-shaped opening is defined by an outer arm 72, a bight portion 74 and an inner arm 76. Preferably, a notch 78 is formed at the juncture between the outer arm 72 and the bight portion 74. The notch 78 provides flexibility to the outer arm 72 as the support bar 38 is selectively mounted therein. Prior to mounting the support bar 38 in the U-shaped opening, the size of the opening is preferably slightly smaller than the diameter of the support bar 38. As the support bar is inserted into the opening, the outer arm 72 deflects somewhat, permitting entry of the support bar 38 into the U-shaped opening. The combined force of a rounded tip 80 at the end of the outer arm 72 and the resiliency of the outer arm 72 retain the support bar 38 within the U-shaped opening.

In use, the table 12 can be assembled such that the support bar 38 is received in the second tube receiving opening 70. In the second embodiment, this position corresponds to a table height of approximately 29 inches, the standard table height. If the table is to be used by a wheelchair user, the support bar 38 is removed from the second tube receiving opening 70 and inserted into the first tube receiving opening 68. Because the first and second legs, 16, 18, are pivotally mounted to the third and fourth legs, 20, 22, the table top 14 is raised a distance corresponding to the separation between the first tube receiving opening 68 and the second tube receiving opening 70. In the second embodiment, as seen herein, the second tube receiving opening 70 corresponds to a table height of approximately 31 inches, a height suitable for use with most wheelchairs.

Figure 12:
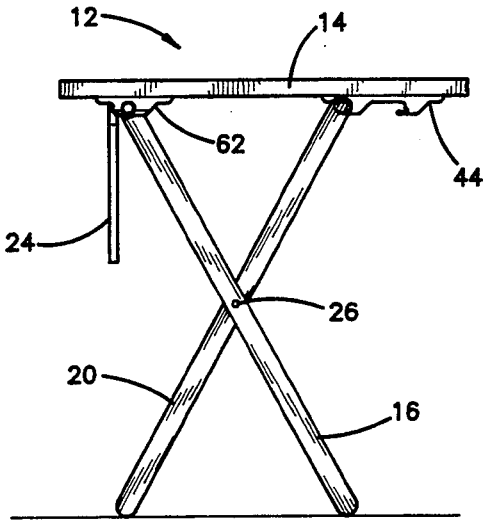
FIG. 12 is a side elevational view of the second embodiment of the adjustable table in the first or upper erect state.
Figure 13:
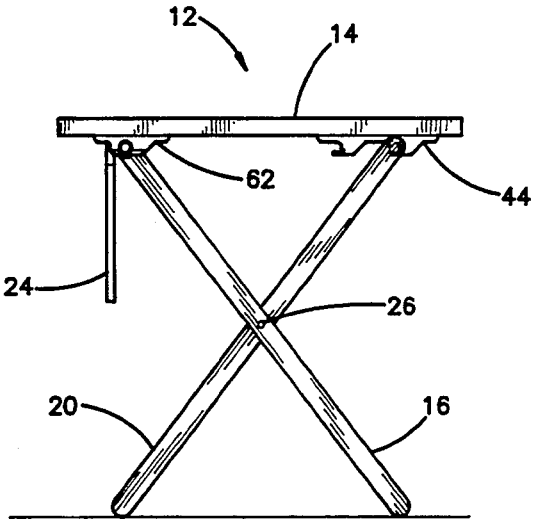
FIG. 13 is a side elevational view of the second embodiment of the adjustable table in the second or lower erect state.
Figure 15:
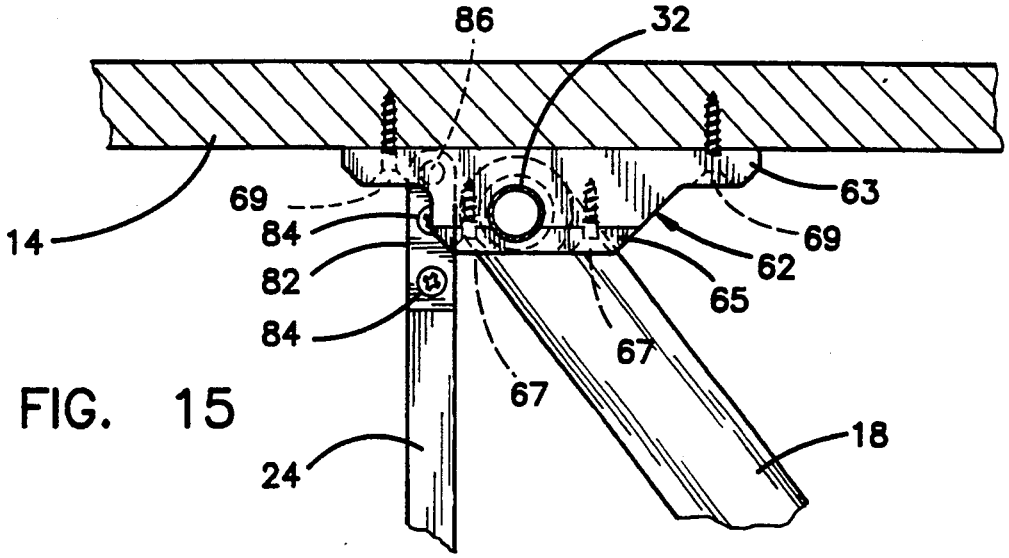
FIG. 15 is a partial sectional view of the second embodiment of the table showing the pivot bracket taken along lines 15—15 of FIG. 11.

The second embodiment of the adjustable table 12 according to the invention can be easily collapsed so that it can be stored in a flat condition, occupying a minimum amount of space. The erect table 12 as seen in FIG. 12 can be collapsed as seen in FIG. 15 by removing the support bar 38 from the second tube receiving opening 70 and pivoting the support bar 38 such that it is adjacent the horizontal portions 30 and 32 of the first and second legs, 16 and 18. In this position, the first and second legs are parallel and immediately adjacent to the third and fourth legs 20 and 22, respectively. Thereafter, the legs 16, 18, 20 and 22 and the support bar 38 can be pivoted until the legs abut the underside of the table top 14. In this position, the maximum thickness of the folded table is equal to the thickness of the table top 14 and the widest of all of the legs 16, 18, 20 and 22.

The legs lie substantially flat against the underside of the table top 14 because of the combination of the U-shaped structure of the support bar 38 and third and fourth legs, 20, 22, and the L-shaped construction of the first and second legs, 16, 18. In addition, the first and second legs, 16, 18, are mounted to the table top 14 such that the legs will not be trapped beneath or interfere with the third and fourth legs, 20, 22, or the support bar 38 as the legs are folded against the underside of the table. Similarly, the support bar 28 and the third and fourth legs, 20, 22, do not interfere with and are not trapped beneath the first and second legs, 16, 18 as the first and second legs are folded against the underside of the table top 14. This orientation permits the table to be collapsed such that a minimum amount of space is occupied by the collapsed table.

Figure 16:
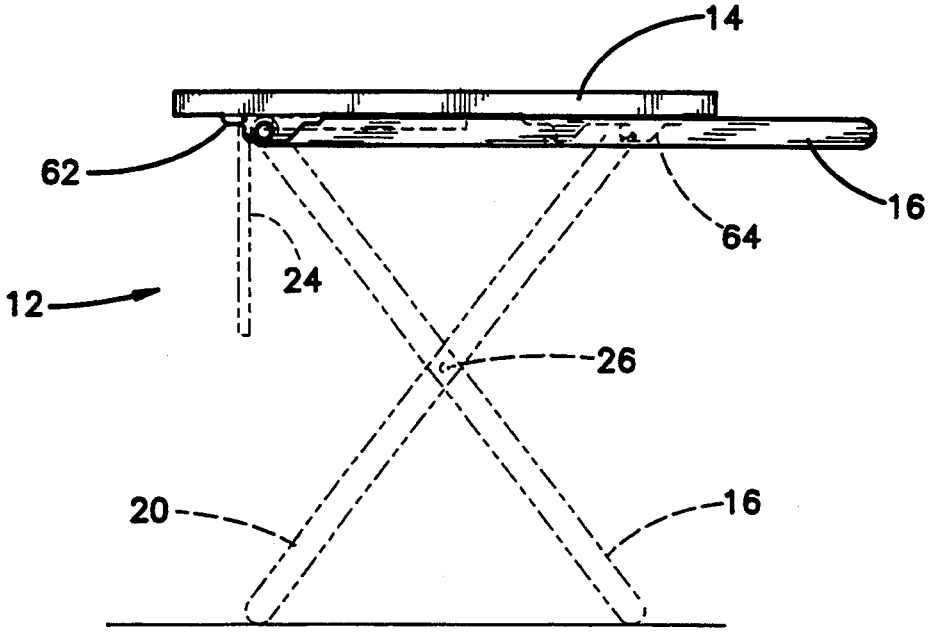
FIG. 16 is a side elevational view of the second embodiment of the table in its collapsed state, the adjustable table in its lower erect state being depicted in phantom lines.

A modesty panel 24 can be pivotally mounted to the underside of either embodiment of the article of furniture at a front portion thereof. The modesty panel 24 is not a required element of the invention, but rather is a desired option when the table 12 is used as a conference table or a desk. As seen in FIGS. 6 and 9, the modesty panel 24 is pivotally mounted to the underside of the table top 14 by a rotating member 82. One end of the rotating member 82 is securely attached to the modesty panel 24 by a plurality of mounting screws 84. The other end of the rotating member 82 is pivotally attached to the guide track 46 by a pivot pin 86. With this arrangement, the modesty panel 24 can be folded flat against the underside of the table top 14 when the adjustable table is collapsed as seen in FIGS. 10 and 16.

In light of the recent legislation requiring businesses to make facilities accessible for use by wheelchair users, the public must either change all tables from the standard height of approximately 29 inches to approximately 31 inches or install adjustable tables which can accommodate multiple height positions. Similarly, restaurants and conference facilities which make use of folding tables must also have adjustable folding tables for use by wheelchair users. The folding table according to the invention creates a simple, economical table which is comfortable for use at standard height and comfortable for use by wheelchair users at a second, higher position of approximately 31 inches. The adjustable table according to the invention is easily collapsed to a flat state and occupies a minimum amount of storage space. It is to be understood that the height adjustments described above are only the preferred embodiment and different height adjustments or more than two height adjustment positions can be easily incorporated into the table according to the invention.

While particular embodiments of the invention have been shown, it will be understood, of course, that the invention is not limited thereto since modifications can be made by those skilled in the art, particularly in light of the foregoing teachings. Reasonable variation and modification are possible within the foregoing disclosure of the invention without departing from the scope of the invention.

The embodiments of the invention in which an exclusive property or privilege is claimed are defined as follows:

1. An article of furniture supported on a supporting surface comprising:

a table top;

first and second legs pivotally mounted at upper ends thereof to an underside of the table top;

third and fourth legs pivotally connected respectively to the first and second legs at an intermediate position of each of the first, second, third and fourth legs;

a guide track mounted to the underside of the table top;

a slide bar slidably mounted in the guide track; and a shackle bar having a first end pivotally mounted to the slide bar and a second end pivotally mounted to the upper end of the third and fourth legs, the shackle bar selectively supporting an upper end of the third and fourth legs in one of two positions relative to the table top, a first of the two positions supporting the table top a first distance from the supporting surface and a second of the two positions supporting the table top a second and different distance from the supporting surface; and the slide bar being further slidably mounted to the guide track such that the third and fourth legs are moveable from the first and second table top supporting positions to a collapsed position wherein the legs are substantially parallel to the underside of the table top.

2. An article of furniture according to claim 1 and further comprising a support bar interconnecting the upper ends of the third and fourth legs, the support bar extending along the underside of the table top.

3. An article of furniture according to claim 1 wherein the guide track is generally U-shaped in cross section and the slide bar is complementary in cross section to the guide track.

4. An article of furniture according to claim 1 and further comprising a modesty panel mounted to the underside of the table top.

5. An article of furniture according to claim 4 wherein the modesty panel is pivotally mounted to the underside of the table top adjacent the upper ends of the first and second legs.

6. An article of furniture according to claim 1 wherein the first and second legs are generally L-shaped and a horizontal portion thereof at an upper portion of the legs is pivotally mounted to the underside of the table top.

7. An article of furniture according to claim 6 and further comprising at least one pivot bracket mounted to the underside of the table top to receive the horizontal portions of the first and second legs.

8. An article of furniture according to claim 1 further comprising at least one pivot bracket mounted to the underside of the table top to receive a top end of the first and second legs.

9. An article of furniture comprising;

a table top;

a shackle bar having a first end and a second end, the first end being pivotally mounted to an underside of the table top;

a first and second leg pivotally mounted to the underside of the table top in spaced apart parallel orientation;

a third and fourth leg pivotally connected respectively to the first and second legs at an intermediate position of each of the first, second, third and fourth legs and the third and fourth legs being pivotally mounted to the second end of the shackle bar, the shackle bar selectively supporting the table top in one of two positions such that the table top is spaced from the floor a first distance when the shackle bar is in a first of the two positions and the table top is spaced from the floor a second distance when the shackle bar is in a second of the two positions; and a slide bar mechanism mounted to the underside of the table top, the shackle bar being mounted to the slide bar mechanism and the legs and slide bar mechanism being adapted so that the article can be folded to a collapsed position, the thickness of the article of furniture in the collapsed position being substantially equal to the width of one of the widest of the legs, the thickness of the table top and the thickness of the slide bar mechanism.

10. An article of furniture according to claim 9 wherein the third and fourth legs are interconnected by a support bar at an upper end of the third and fourth legs.

11. An article of furniture according to claim 9 wherein the slide bar mechanism further comprises a guide track mounted to the underside of the table top and a slide bar slidably mounted in the guide track, the second end of the shackle bar being pivotally mounted to the slide bar.

12. An article of furniture according to claim 11 wherein the guide track is generally U-shaped in cross section and the slide bar is complementary in cross section to the guide track.

13. An article of furniture according to claim 9 and further comprising a modesty panel mounted to the underside of the table top.

14. An article of furniture according to claim 13 wherein the modesty panel is pivotally mounted to the underside of the table top.

15. An article of furniture according to claim 9 wherein the first and second legs are generally L-shaped and a horizontal portion thereof at an upper portion of the legs is pivotally mounted to the underside of the table top.

16. An article of furniture according to claim 15 and further comprising at least one pivot bracket mounted to the underside of the table top to receive the horizontal portions of the first and second legs.

17. An article of furniture according to claim 9 further comprising at least one pivot bracket mounted to the underside of the table top to receive a top end of the first and second legs.

18. An article of furniture comprising;

a table top;

at least one adjustment bracket having at least two leg mounting retainers, the leg mounting retainers comprising a U-shaped member having a resilient arm and a rounded tip at a distal end of the resilient arm to releasably retain the support bar;

a first and second leg pivotally mounted to an underside of the table top in a spaced apart parallel orientation; and a third and fourth leg interconnected by a support bar at an upper end and pivotally connected respectively to the first and second legs at an intermediate position of each of the first, second, third and fourth legs, the support bar extending along the underside of the table top, the support bar being selectively mounted to each of the at least two leg mounting retainers of the at least one adjustment bracket such that the table top is spaced from the floor a first distance when the support bar is mounted in the first of the at least two leg mounting retainers and the table top is spaced from the floor a second distance when the support bar is mounted in the second of the at least two leg mounting retainers.

19. An article of furniture according to claim 18 wherein the legs are configured and spaced so that the article can be collapsed and the thickness of the article of furniture when collapsed is substantially equal to the width of one of the widest of the legs and the thickness of the table top.

20. An article of furniture according to claim 18 and further comprising a modesty panel mounted to the underside of the table top.

21. An article of furniture according to claim 20 wherein the modesty panel is pivotally mounted to the underside of the table top.

22. An article of furniture according to claim 18 wherein the first and second legs are generally L-shaped and a horizontal portion thereof at an upper portion of the legs is pivotally mounted to the underside of the table top.

23. An article of furniture according to claim 22 and further comprising at least one pivot bracket mounted to the underside of the table top to receive the horizontal portions of the first and second legs.

24. An article of furniture according to claim 18 further comprising at least one pivot bracket mounted to the underside of the table top to receive a top end of the first and second legs.

25. An article of furniture according to claim 18 wherein the support bar is tubular in shape.

26. An article of furniture according to claim 18 further comprising a notch formed in the leg mounting retainers at a base of the resilient arm.

* * * * *